US005565649A

United States Patent [19]

Tougeron et al.

[11] Patent Number: 5,565,649

[45] Date of Patent: Oct. 15, 1996

[54] PROJECTILE, IN PARTICULAR A NON-LETHAL BULLET

[75] Inventors: Raymond Tougeron, Pamiers; Daniel Casenave, Castanet Tolosan, both of France

[73] Assignee: Ruggieri, Cedex, France

[21] Appl. No.: 413,824

[22] Filed: Mar. 30, 1995

[30] Foreign Application Priority Data

Mar. 31, 1994 [FR] France ..... 94 03852

[51] Int. Cl.[6] ..... F42B 12/36

[52] U.S. Cl. ..... 102/502; 102/370; 102/374; 102/432; 102/513; 102/529

[58] Field of Search ..... 102/370, 374, 102/376, 395, 432, 498, 502, 513, 529, 444, 445, 439, 357, 351

[56] References Cited

U.S. PATENT DOCUMENTS

| | | | |
|---|---|---|---|
| 1,671,364 | 12/1926 | Gangnes . | |
| 2,112,758 | 3/1938 | Blacker | 102/370 |
| 2,408,252 | 9/1946 | De Ganahl | 102/376 |
| 2,444,283 | 6/1948 | Detrich | 102/370 |
| 3,037,454 | 4/1961 | Young . | |
| 3,429,263 | 2/1969 | Snyder et al. | 102/513 |
| 3,782,286 | 1/1974 | Jones et al. . | |
| 3,865,038 | 2/1975 | Barr . | |
| 3,911,824 | 10/1975 | Barr et al. | 102/529 |
| 3,995,550 | 12/1976 | D'Amico, Jr. | 102/517 |
| 4,419,936 | 12/1983 | Coates et al. | 102/364 |
| 4,708,065 | 11/1987 | Schilling et al. | 102/529 |
| 4,932,329 | 6/1990 | Logie | 102/498 |
| 5,018,449 | 5/1991 | Eidson, II | 102/498 |
| 5,035,183 | 7/1991 | Luxton | 102/502 |
| 5,086,703 | 2/1992 | Klein . | |

FOREIGN PATENT DOCUMENTS

| | | | |
|---|---|---|---|
| 542590 | 6/1957 | Canada | 102/432 |
| 2213572 | 8/1989 | United Kingdom . | |

*Primary Examiner*—Harold J. Tudor
*Attorney, Agent, or Firm*—Sughrue, Mion, Zinn, Macpeak & Seas

[57] ABSTRACT

The projectile, in particular a bullet, comprises a body (1) comprising a receiving cavity (6) containing a product (8) which is active on the organism of a live target, and means for releasing this product upon the impact of the projectile on the target. The body (1) of the projectile includes a propelling motor (5) and, along the length of the body, a portion (30) of smaller diameter followed by a shoulder (32) constituting a braking plane perpendicular to the direction of travel of the projectile. Application in bullets for disabling an opponent with no risk of fatal injury.

13 Claims, 2 Drawing Sheets

PROJECTILE, IN PARTICULAR A NON-LETHAL BULLET

BACKGROUND OF THE INVENTION

The present invention relates to a projectile, in particular a bullet, adapted to disable with no major risk of fatally wounding an opponent.

Such projectiles are employed by police forces for stopping disturbances on the street in the course of violent demonstrations or riots.

Projectiles of rubber or like materials are at present known in the art which are intended to be directly fired at demonstrators to neutralize them. The propellant charges are so adapted that the impact of the projectile on the demonstrator only produces bruises without danger to the life of the demonstrator.

Other types of projectiles are also known for use when confronting demonstrators, in particular projectiles which are fired in the direction of but over the crowd and release suffocating or irritating gases causing the dispersion of the demonstrators.

with the first type of projectile, the effect produced by the impact is not always sufficient to stop the assaulter above all if he is protected by a shield.

Projectiles releasing gases have the drawback of releasing their substance in a very large space owing to the type of the shot and therefore cause discomfort to a large number of persons present who sometimes include persons not involved in the disturbances, or even the police forces when they take back ground which was previously occupied by the demonstrators at the time of the shooting and over which the air is highly charged with the gases.

SUMMARY OF THE INVENTION

An object of the present invention is therefore to combine in the same projectile the advantages of the aforementioned two types of projectiles while avoiding the undesirable effect of the excessive dispersion of the gases.

The invention consequently has for purpose to propose a projectile which creates an impact effect when the projectile strikes the target and a neutralizing effect upon release of an irritating fluid in the vicinity of the point of impact.

The invention therefore provides a projectile or bullet characterized in that it comprises a body including a receiving cavity containing a product which is active on a target which is live or otherwise, and means for releasing said product upon the impact of the projectile on the target, the body of the projectile comprising a propelling motor and, in the length of the body, a portion of smaller diameter followed by a shoulder constituting a braking plane perpendicular to the direction of travel of the projectile.

According to other features of the invention:

the body comprises rupture-initiating means which facilitate the bursting of the body upon impact and permit the release of the product contained in the cavity;

the rupture-initiating means are formed by cuts along generatrices of the body;

the body comprises in the nose thereof means for absorbing a part of the energy upon impact;

the body comprises a deformable solid element having a generally ogival shape extended by a skirt defining the cavity for the product and connected to a base;

the rupture-initiating means are provided in the skirt at least in facing relation to the receiving cavity containing the product;

the skirt of the body comprises at least one part in the form of a compressible bellows for absorbing a part of the energy upon impact;

the nose of the body forms a tapered plug of which a part projects outside the skirt and a part is engaged in the skirt and initiates the rupture of the body upon impact;

the receiving cavity containing the product includes a capsule forming a container containing the product;

the receiving cavity containing the product comprises a spongy material capable of containing the fluid;

the nose of the body is made of a contusion-forming material such as rubber;

the receiving cavity containing the product comprises along the axis thereof a tube connected to the base of the projectile and closed with respect to said base, and the nose comprises a piston adapted to cooperate with the tube and cause the bursting of the latter by the increase in the pressure of the air trapped in the tube upon impact, thereby facilitating the release of the product contained in the cavity.

BRIEF DESCRIPTION OF THE DRAWINGS

A better understanding of the invention will be had and other advantages will be apparent from the following description which is given solely by way of example with reference to the accompanying drawings, in which.

DETAILED DESCRIPTION OF THE PREFERRED EMBODIMENT

Figure 1:
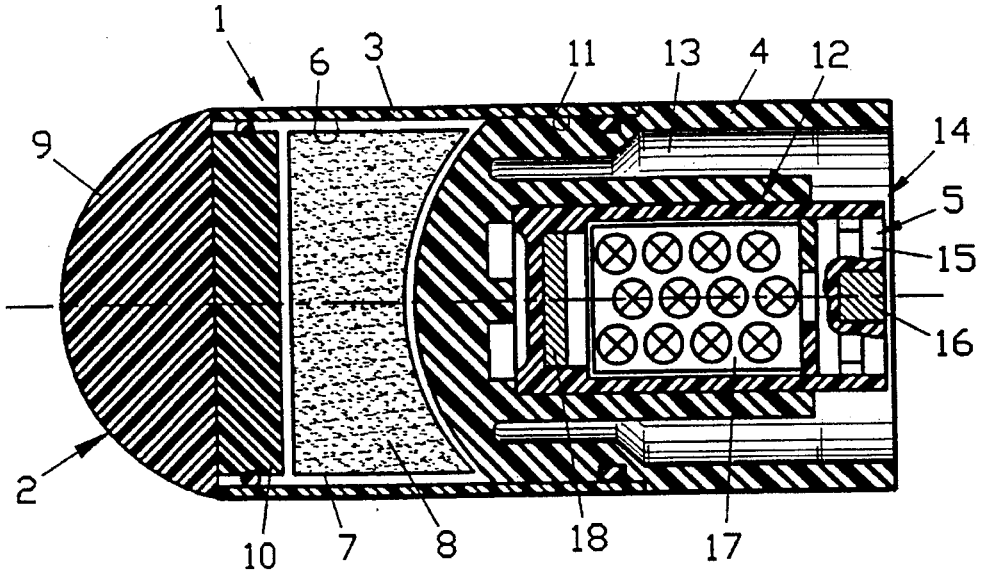
FIG. 1 is a sectional view of a projectile according to the invent ion.

Shown in FIG. 1 is a self-propelling projectile according to the invention which comprises a body 1, formed by a nose 2 having a rounded front end and extended by a cylindrical skirt 3 connected to a base 4 carrying a motor 5. In the presently-described embodiment, the cylindrical skirt 3 and the base 4 are two distinct parts fitted together, but it is also possible to envisage an arrangement in which the cylindrical skirt 3 is in one piece with the base 4.

The skirt 3 defines a cavity 6 between the nose 2 and the base 4. A capsule 7 containing an irritating liquid 8 is placed in this cavity 6.

The thickness of the walls of the capsule 7 is such as to permit the rapid rupture of the walls as soon as the irritating liquid 8 is subjected to great pressure which in this way releases the liquid.

The nose 2 has a part 9 of ogival shape made of a material capable of absorbing by deformation a part of the energy of the impact (for example rubber). This ogival part is completed by a solid cylindrical element 10 of rigid plastics material adhered to a planar base of the part 9.

The base 4 having a generally cylindrical shape comprises a guiding wall 11 for fitting the base in the skirt 3 and thereby forming a compact assembly which forms with the nose 2 the body 1 of the bullet. The base 4 comprises at its rear end a central recess 12 in which the motor 5 is disposed.

The base 4 is made by moulding a plastics material and includes hollowed out parts 13 to reduce the total weight thereof.

The motor 5 is of conventional design for self-propelled projectiles. It comprises a cylindrical body 14 and a nozzle 15 both of which are made of metal.

The cylindrical body of the motor may also be formed by the walls of an axial bore formed in the base 4.

The nozzle is set, adhered or machined on the body 14.

The nozzle 15 comprises in the centre, flush with the rear face of the base 4, a primer 16 actuated by percussion or electrically, depending on the type of the launcher employed.

The cylindrical body 14 of the motor 5 constructed in this way contains a propellant powder 17 connected to the primer 16 by suitable conventional means. A volume-compensating member 18 is added in the motor in accordance with the amount of necessary powder.

The number, the inclination and the diameter of the apertures of the nozzle 15, the volume and the nature of the powder, and the size of the compensating member 18 are adapted to the desired characteristics of the projectile.

Such a projectile is intended to be fired from an individual arm comprising a barrel adapted to the calibre of the projectile and a device for igniting the primer. As can be seen in FIG. 1, such a projectile according to the invention does not include a case and therefore leaves nothing in the arm after firing.

Figure 2:
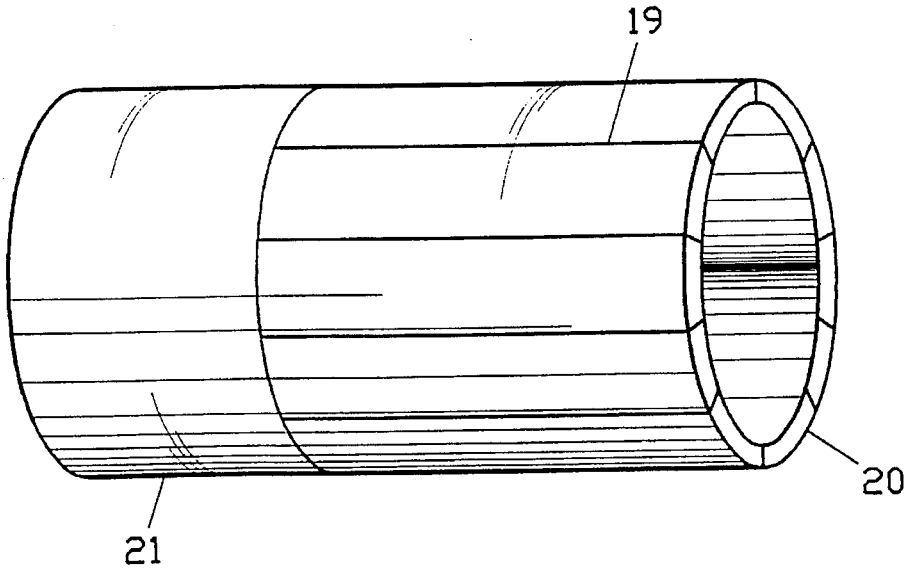
FIG. 2 is a perspective view of an embodiment of the projectile body provided with rupture-initiating means according to the invention.

FIG. 2 shows an embodiment of the skirt 3 of the previously-described projectile. The skirt 3, made of a plastics material, comprises along generatrices rupture-initiating means 19 opening onto one end 20 of the skirt. When the projectile has been assembled, these rupture-initiating means are in facing relation to the cavity 6 containing the liquid 8. The part 21 of the skirt devoid of rupture-initiating means is adapted to receive the base 4.

When the described projectile strikes a target, the nose 2 is crushed against the target and absorbs by deformation a part of the energy of the bullet.

The cylindrical element 10 then compresses the fluid 8 contained in the capsule 7 against the base 4 and causes the rupture of the walls of the capsule and consequently the release of the fluid contained in the latter.

Under the effect of the impact, the skirt 3 becomes torn in the shape of a tulip along the rupture-initiating means 19 and allows the irritating fluid 8 contained in the cavity 6 to escape to the exterior.

Figure 3:
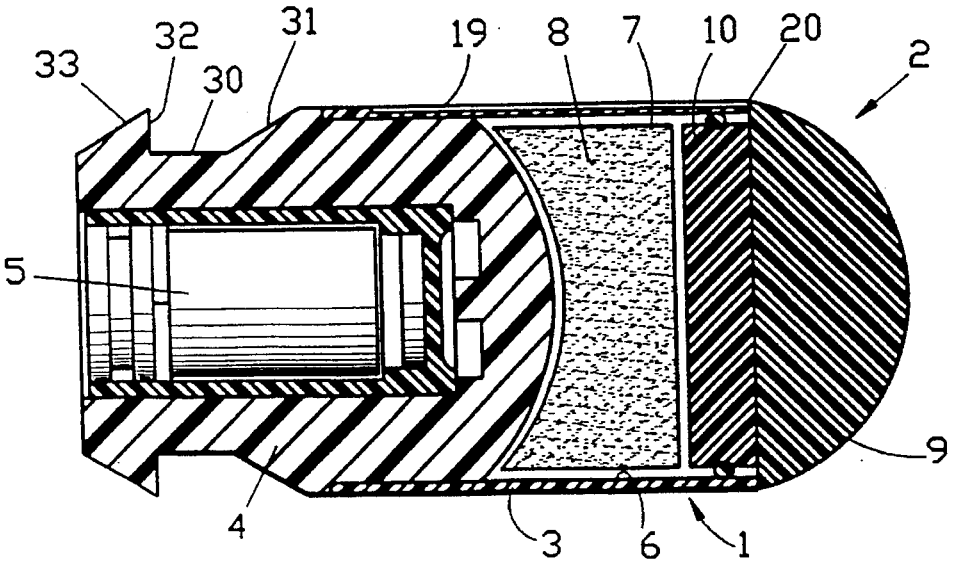
FIGS. 3, 4 and 6 are sectional views of other embodiments of the projectile according to the invention.

FIG. 3 is a diagrammatic view of a projectile of the same type as that shown in FIG. 1 but differing from the latter only in respect of the base 4. Indeed, in FIG. 3, the cylindrical base 4 comprises a cylindrical portion 30 of smaller diameter. This portion 30 is extended at one end by a tapered portion 31 divergent toward the front end of the projectile, and is defined at the rear by a stabilizing braking plane 32. The rear of the base extending beyond the braking plane 32 is chamfered at 33.

This particular structure is adapted to brake the bullet in that it offers to the air means resisting the travel of the bullet. Further, the braking plane 32 serves to stabilize the bulle.

According to needs, the dimensions and the shapes of the outer contour of the body of the bullet may be modified.

Figure 4:
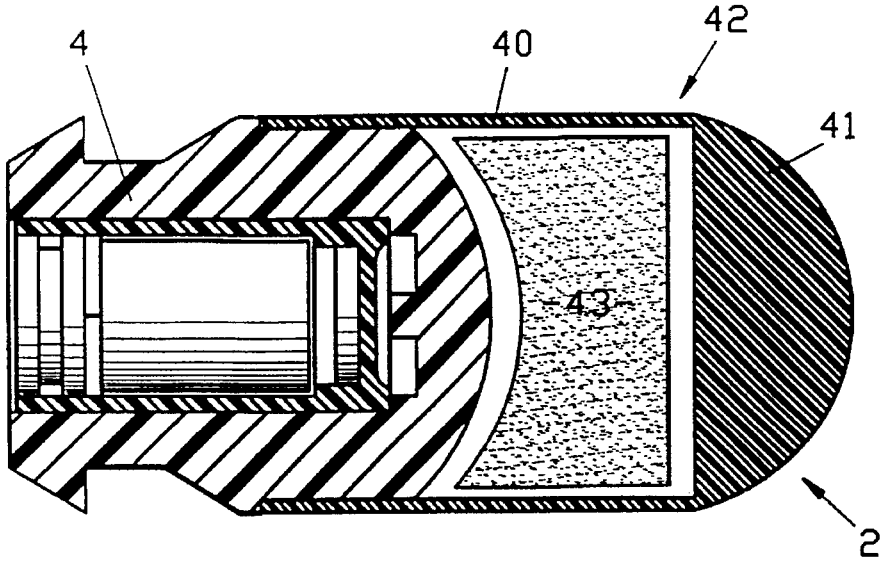

FIG. 4 shows a projectile similar to that described with reference to FIG. 1, some elements having been omitted.

In this Figure, the skirt 40 is in one piece with the ogival part 41 of the nose 2, thereby forming a cap 42 made of a deformable material (for example rubber), and forms with the base 4 engaged in the skirt 40, as shown in FIG. 4, a cavity 43 containing the irritating liquid.

Figure 5:
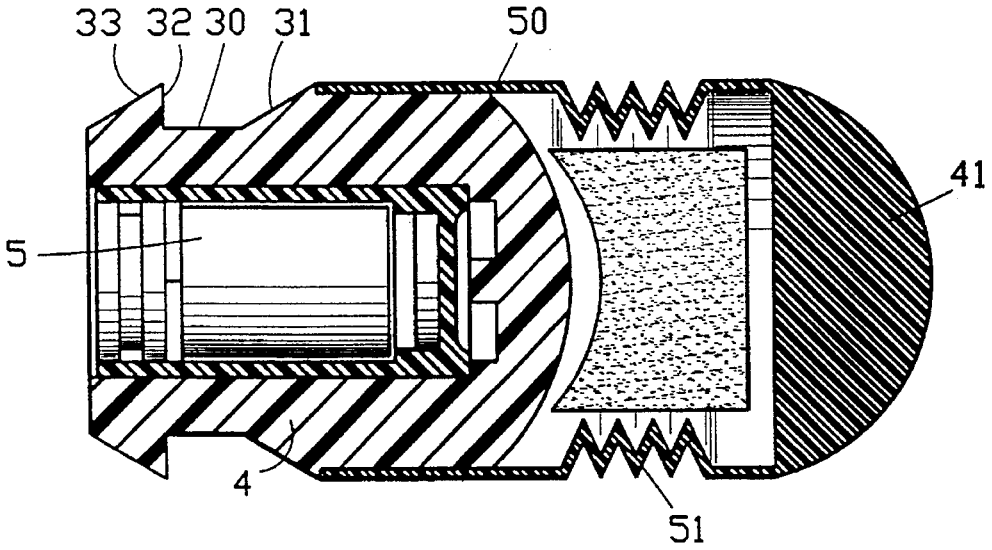
FIG. 5 is a sectional view of an embodiment of a body according to the invention including a compressible bellows.

In a further embodiment of the invention, shown in FIG. 5, the skirt 50 in one piece with the ogival part 41 of the nose 2 comprises a portion 51 in the form of a compressible bellows. This bellows is adapted to absorb a part of the energy upon impact.

This portion 51 in the form of a compressible bellows defines with the base engaged in the skirt (not shown) the cavity for the fluid which is therefore in facing relation to the bellows.

Figure 6:
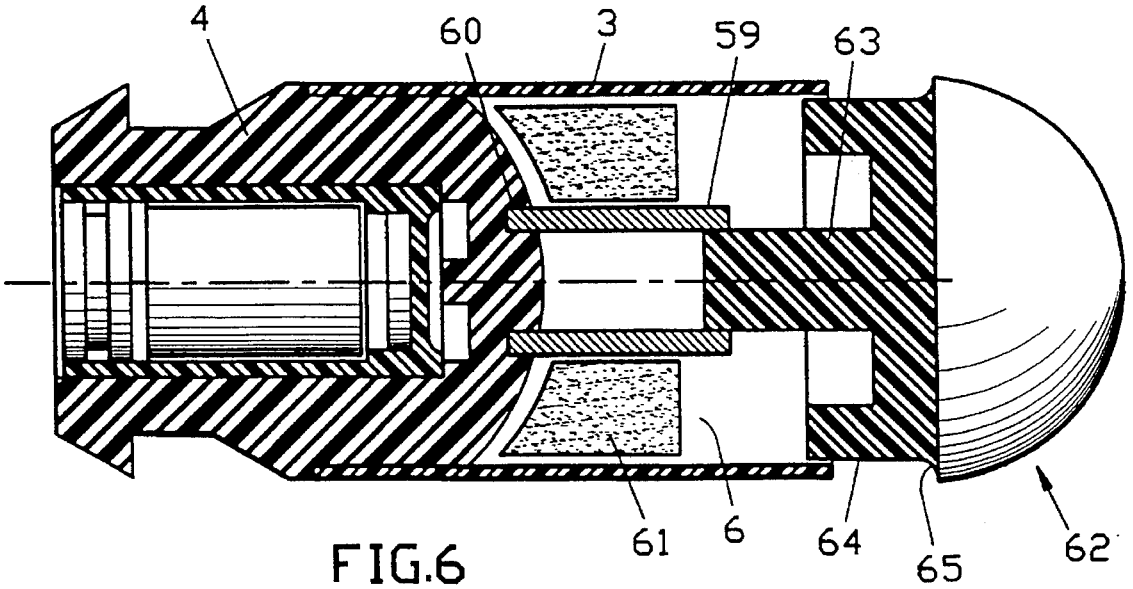

A projectile according to another embodiment of the invention is shown in FIG. 6. A tube 59 coaxial with the base 4 and the skirt 3 extends from the base 4 in the cavity 6 for containing the fluid. A circular groove 60 is provided in the base 4 to permit the insertion of the tube in the latter. An adhesive may be added upon assembly to ensure fluidtightness between the tube and the base.

In this case, the cavity 6 for containing the fluid has a toroidal shape and contains a spongy material 61 adapted to contain the irritating liquid.

A nose 62 constituting a plug has a projecting hemispherical end portion. It is provided with an axial piston 63 engaged in the tube 59.

Guiding means 64 in one piece with the nose 62 enable the nose to penetrate the skirt 3 along the main axis of the projectile upon impact.

The guiding means 64 comprise a cylindrical portion which cooperates with the end of the skirt 3 and defines in the vicinity of the hemispherical portion of the nose a tapered or divergent portion 65 whose maximum diameter is larger than the inside diameter of the skirt 3. Upon impact, the nose constituting a plug penetrates the skirt 3 and the tapered portion 65 of the nose facilitates the bursting of the skirt.

Upon impact, the piston 63 penetrates further into the tube 60 which, under the effect of the increased pressure of the air therein, bursts and thus facilitates the dispersion of the fluid 8 contained in the capsule 7 through the skirt 3 which is torn along the rupture-initiating means thereof.

The foregoing description describes projectiles containing an irritating fluid. The latter may of course be replaced by any other fluid, for example a marking fluid.

In each of the embodiments described hereinbefore, either a capsule or a spongy body may be used for containing the irritating fluid 8.

The fluid may also be placed directly in the cavity 6 defined by the skirt 3, the nose 2 and the base 4.

Further, a projectile according to the invention may be imagined which is not self-propelling. For this purpose it is sufficient to eliminate the motor from the base of the projectile and provide the resulting projectile with a case containing powder and means for igniting this powder.

However, the fact that the projectile carries the propelling motor results in a number of advantages.

In particular, the propelling motor always remains connected to the projectile. Consequently, this type of projectile leaves no element, such as for example a case, in the launcher. It may be fired from a launcher which is of very simple design, easy to use, very easy to handle and does not require the use of a gun, for example of the anti-riot type, with a charger and case ejecter.

Moreover, the propelling motor may be of the self-propelled type which imparts to the projectile an increasing speed in a part of its trajectory. The projectile consequently reaches its full effectiveness at a given firing distance. In the first part of the trajectory, the effect is therefore attenuated, which affords safety in this part.

Further, the propelling motor may be of the impulse type; this imparts a given initial speed to the projectile which is thereafter substantially constant. In this way the projectile has the same effectiveness and the same safety throughout its operative trajectory.

The projectile may be used on a live target but also on a fixed or mobile non-live target, in particular when the fluid contained in the projectile is a marking fluid.

Further, the aforementioned fluid or liquid may be replaced by any type of product, for example a powder.

What is claimed is:

1. A non-lethal projectile, comprising in combination: a body including a receiving cavity, a product which is contained in said cavity and is active on a target which is live, means for releasing said product upon impact of said projectile on said target, and a propelling motor disposed in said body, said body having in the length of said body a portion of smaller diameter than the diameter of said body followed, relative to the direction of travel of said projectile, by a shoulder constituting a projectile braking plane perpendicular to said direction of travel.

2. Projectile according to claim 1, comprising rupture-initiating means on said body for facilitating the bursting of said body upon impact of said projectile on said target and permitting the release of said product contained in said cavity.

3. Projectile according to claim 2, wherein said rupture-initiating means are formed by cuts provided along generatrices of said body.

4. Projectile according to claim 1, wherein said body comprises a nose including means for absorbing a part of the energy upon impact of said projectile on said target.

5. Projectile according to claim 1, wherein said body comprises a deformable solid element having a substantially ogival shape, a skirt which extends said deformable element and defines said cavity, and a base connected to said skirt.

6. Projectile according to claim 2, wherein said body comprises a deformable solid element having a substantially ogival shape, a skirt which extends said deformable element and defines said cavity, and a base connected to said skirt, said rupture-initiating means being provided in said skirt at least in facing relation to said cavity containing said product.

7. Projectile according to claim 5, wherein said skirt of said body comprises at least one part in the form of a compressible bellows for absorbing a part of the energy upon impact of said projectile on said target.

8. Projectile according to claim 5, wherein said body comprises a nose constituting a tapered plug having a part projecting outside said skirt and a part which is engaged in said skirt and initiates said rupture of said body upon impact of said projectile on said target.

9. Projectile according to claim 1, comprising a capsule containing said product and disposed in said cavity.

10. Projectile according to claim 1, comprising spongy material capable of containing fluid and disposed in said cavity.

11. Projectile according to claim 1, wherein said body has a nose made of a contusion-forming material.

12. Projectile according to claim 11, wherein said contusion-forming material is rubber.

13. A non-lethal according to claim 1, wherein said body includes a nose, said cavity comprises along the axis thereof a tube connected to said base and closed with respect to said base, said nose comprising a piston cooperative with said tube for causing upon impact of said projectile on said target the bursting of said tube by increase in the pressure of air trapped in said tube, thereby facilitating the release of said product in said cavity.

* * * * *